US005226829A

United States Patent [19]

Jones

[11] Patent Number: 5,226,829

[45] Date of Patent: Jul. 13, 1993

[54] UNDERGROUND STAKE DEVICE

[76] Inventor: Don W. Jones, 1121 Hughes, Des Moines, Iowa 50315

[21] Appl. No.: 886,524

[22] Filed: May 20, 1992

[51] Int. Cl.[5] ..... E04H 15/62

[52] U.S. Cl. ..... 135/118; 52/148; 52/166; 52/706

[58] Field of Search ..... 135/118, 119, 120, 87, 135/907; 24/115 K; 52/146–149, 150–166, 700–704, 706, 707, 23

[56] References Cited

U.S. PATENT DOCUMENTS

| | | | |
|---|---|---|---|
| 1,008,323 | 11/1911 | Gillespie | 52/162 |
| 1,161,303 | 11/1915 | Fritz | 135/118 X |
| 1,555,322 | 9/1925 | Kleinhesselink . | |
| 1,566,846 | 12/1925 | Fielding | 52/163 |
| 1,592,128 | 7/1926 | Steinbreder | 135/118 |
| 1,724,401 | 8/1929 | Green et al. | 52/161 |
| 1,781,350 | 11/1930 | Taylor . | |
| 2,863,535 | 12/1958 | Clapper | 52/161 |
| 2,910,149 | 10/1959 | Lionberger | 52/162 X |
| 3,280,829 | 10/1966 | Glendenning et al. | 135/118 |
| 3,550,343 | 12/1970 | Buske | 52/166 X |
| 3,772,838 | 10/1973 | Virnig | 52/23 X |
| 3,990,207 | 11/1976 | Eck et al. | 52/704 |
| 4,271,646 | 6/1981 | Mills | 52/166 X |
| 4,750,508 | 6/1988 | Tatoian | 135/118 X |

FOREIGN PATENT DOCUMENTS

| | | | |
|---|---|---|---|
| 1027588 | 5/1953 | France | 135/118 |
| 1217823 | 5/1960 | France | 135/118 |
| 1281635 | 1/1987 | U.S.S.R. | 52/163 |
| 2216924 | 10/1989 | United Kingdom | 52/166 |

*Primary Examiner*—Carl D. Friedman
*Assistant Examiner*—Lan M. Mai
*Attorney, Agent, or Firm*—Brian J. Laurenzo; Kent A. Herink

[57] ABSTRACT

An improved stake device is provided which is capable of prolonged or even permanent ground position and location in a manner which is completely submerged below ground level at all times. The stake device allows for engaging and holding a securement line which may be removed from the stake device without movement of the stake device from its ground location and position. The stake device includes a longitudinal stake member which is attached to an open cylindrical housing member. A line receiving member is extended laterally from the frame of the housing member into an interior cavity therein for releasable fastening by a corresponding connection member of the securement line.

13 Claims, 1 Drawing Sheet

UNDERGROUND STAKE DEVICE

BACKGROUND OF THE INVENTION

The present invention relates generally to stake devices and, more particularly, to an underground stake device which is capable of prolonged or even permanent position and location in a manner which is completely submerged below ground level. The stake device remains in its ground position and location upon removal of a securement line from the stake device as well as during non-use of the stake device.

It is known to use stakes and securement lines for holding objects up from or anchoring objects to the ground. Such common uses for stakes and securement lines are to hold tents, awnings, and volleyball nets up from the ground, anchoring boats to the ground, and even securing animals within a limited area. A problem which arises is that the connection point for the securement line on the stake is often located in such a manner that the stake must be partially removed from the ground in order to remove the securement line from the stake. This is often difficult if a stake is securely held in the ground. Furthermore, numerous up and down movements of a stake tend to weaken the grip of the ground about the stake thus requiring that the stake be redriven into a second location for the next use.

Another problem which has arisen is that stakes usually protrude above the ground surface which creates a dangerous situation during non-use and even during use of the stake. The protruding stake presents a serious danger of tripping passersby. Furthermore, a protruding stake may be struck by a grass mowing machine which can cause serious injury to nearby people and animals, as well as damage to the mowing machine. Even if a protruding stake is detected before passing over same with a mowing machine, it is difficult to mow around the stake and, if the stake is removed for mowing, it must be redriven into a second location for the next use. In addition, stakes are often lost when they are removed for periods of non-use.

Yet another problem which occurs in above ground stakes for animal securement is that the animal may become entangled about the stake as it travels about the stake in a circular direction.

SUMMARY OF THE INVENTION

Accordingly, it is an object of the present invention to provide an improved stake device which will engage and hold a securement line for an above ground object.

A further object of the present invention is to provide a stake device which is capable of prolonged or even permanent position and location in a manner which is completely submerged below ground level.

Another object of the present invention is to provide a stake device which remains in its ground position and location upon removal of a securement line from the stake device as well as during non-use.

Still another object of the present invention is to provide a stake device including a securement line receiving member which is located below ground level and is easily accessed from above ground level for releasable fastening by the securement line.

Yet another object of the present invention is to provide a stake device which allows a securement line to swivel about the stake device without becoming entangled in same.

These and other objects of the invention will become apparent upon reference to the following specification, drawings, and claims.

By the present invention, it is proposed to overcome the difficulties encountered heretofore. To this end, an improved stake device for prolonged or even permanent position and location in a manner which is completely submerged below ground level is provided, the stake device which allows for engaging and holding a securement line, the stake device which further remains in its ground position and location upon removal of the securement line as well as during non-use. The stake device comprises a longitudinal stake member, the stake member having a first end and a second end located distally and opposite to the first end; a housing member which is attached proximate to the first end of the stake member, the housing member which has an interior cavity bounded on its sides by a frame, the frame having at least one open end; and a line receiving member extended laterally from the frame into the interior cavity of the housing member, the line receiving member for releasable fastening by corresponding connection means of the securement line for connection of the securement line to the stake device. The stake device is thus completely submerged below ground level at all times and includes a line receiving member which is easily accessed from above ground level.

DETAILED DESCRIPTION OF THE INVENTION

In the figures, there is shown an improved stake device 10 for prolonged or even permanent position and location in a manner which is completely submerged below ground level, the stake device 10 thus allowing for engaging and holding a securement line 12 while remaining in its ground position and location upon removal of the securement line 12 as well as during non-use.

Figure 1:
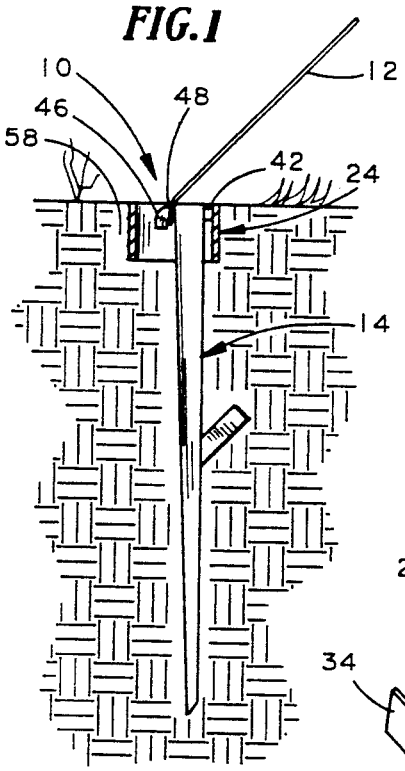
FIG. 1 is an elevational view of an improved stake device which is shown completely submerged below ground level in accordance with the invention.
Figure 2:
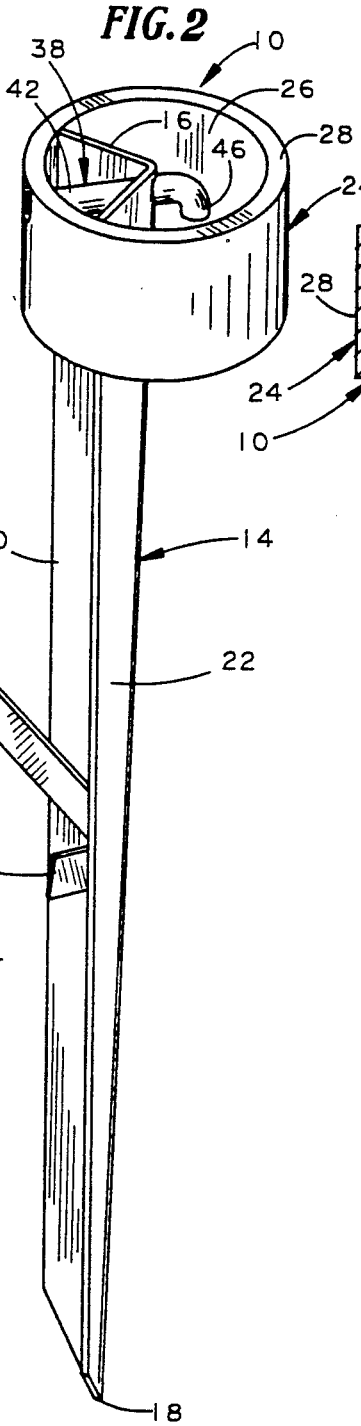
FIG. 2 is a perspective view of the stake device shown in FIG. 1.
Figure 3:
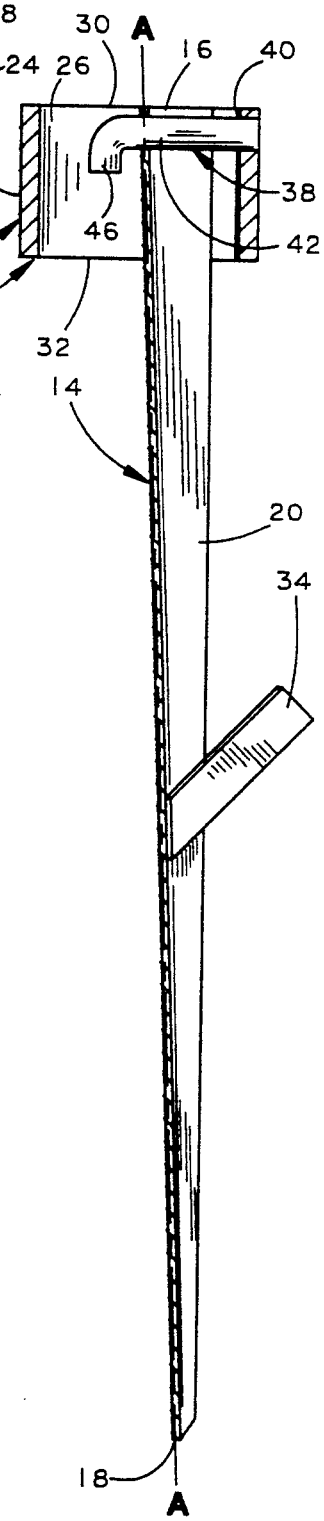
FIG. 3 is an elevational view of the stake device shown in FIG. 2.
Figure 4:
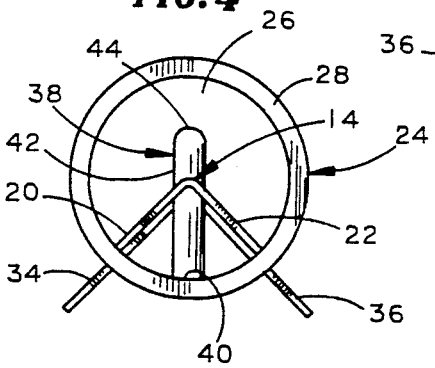
FIG. 4 is a top plan view of the stake device shown in FIG. 2.

In FIG. 1, the stake device 10 is shown submerged completely below ground level with the securement line 12 attached. The stake device 10, as shown in detail in FIGS. 2–4, is comprised of a longitudinal stake member 14, the stake member 14 having a first end 16 and a second end 18 located distally and opposite to the first end 16. In the preferred embodiment, the stake member 14 comprises a channel having a V-shaped cross-section formed by first and second side members 20 and 22 respectively. The channel configuration reinforces the stake member 14 against undesired side-to-side movement during use. The second end 18 of the stake member 14 is pointed so that the stake device 10 may be easily driven into the ground.

The stake device 10 further comprises a housing member 24 which, in the preferred embodiment, has an interior cavity 26 and an outer frame 28 which is cylindrical in shape. The cylindrical frame 28 is open at first and second ends 30 and 32 respectively. The interior cavity 26 is accordingly cylindrical in shape having a circular cross-section. The first and second side members 20 and 22 at the first end 16 of the stake member 14 are attached to the cylindrical frame 28, the first end 16 of the stake member thus being located within the interior cavity 26. The channel shape of the stake member 14 and the circular cross-section of the cylindrical frame 28 allow for a strong connection between the stake member 14 and the housing member 24 which is, in addition, easy to attach.

The stake member 14 further comprises barbs 34 and 36 which are attached to the first and second side members 20 and 22, respectively. As shown in FIG. 3, the barbs 34 and 36 are extended from the stake member 14 at an acute angle from a line which passes along the longitudinal axis A—A of the stake member 14 between the barbs 34 and 36 and the housing member 24. In the preferred embodiment, the barbs 34 and 36 are extended at a 45° angle. The barbs 34 and 36 enable the stake device 10 to be easily driven into the ground while further providing against undesired upward movement during use.

A line receiving member 38 is extended laterally from a side of the frame 28 at 40 into the interior cavity 26 of the housing member 24 for releasable fastening by a corresponding connection member of the securement line 12. As shown in FIG. 4, the preferred line receiving member 38 is comprised of a rod-shaped leg 42 which is extended laterally from the frame 28 at 40 into the interior cavity 26 to a point 44 which is short of an opposing side of the frame 28. The line receiving member 38 may be passed through the first end 16 of the stake member 14 thus allowing the stake member 14 to reinforce the line receiving member 38. The rod-shaped leg 42 may end in a down-turned hook-like member 46 for receipt of a loop-type end 48 or similar connection member of the securement line 12 as shown in FIG. 1. It is contemplated that an eyelet or similar type configuration could be substituted for the hook-like member 46. Other line receiving member configurations are also anticipated. In addition, the rod-shaped leg 42 may be extended laterally outside the housing member 24 for access by the claw portion of a hammer for removal of the stake (not shown).

Figure 5:
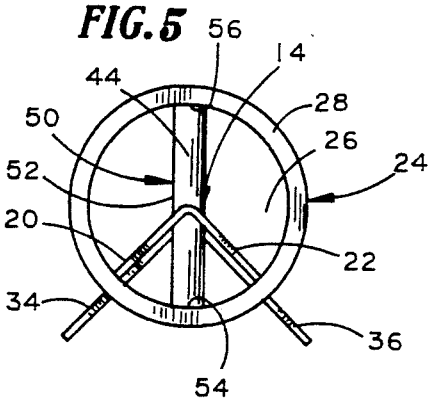
FIG. 5 is a top plan view of an alternative embodiment of the stake device.

An alternative embodiment (as shown in FIG. 5) is anticipated for securement line connection members of the type currently used for animal securement lines such as snap hooks or spring hooks. Such an alternative embodiment includes a line receiving member 50 which is comprised of a rod-shaped leg 52 that is extended from the frame 28 at 54 into the interior cavity 36 to a point 56 which is located on the opposing side of the frame 28. Such a line receiving member 50 is ideal for attachment of the numerous fasteners which are available for releasable securement of animal securement lines as it allows the fasteners and securement lines to swivel about the stake device without becoming entangled with same.

The stake device 10 is placed into the ground by first removing a portion of the ground which corresponds in shape and size to the housing member 24 . The stake device 10 is then driven into the ground so that the housing member 24 seats in a resulting recess 58 (See FIG. 1). The stake device 10 is now located in a prolonged or even permanent ground position and location as no movement of the stake device 10 is required for the removal of the securement line 12 or during non-use.

The foregoing description and drawings merely explain and illustrate the invention and the invention is not limited thereto, except insofar as the claims are so limited, as those skilled in the art who have the disclosure before them will be able to make modifications and variations therein without departing from the scope of the invention. For example, while the line receiving member 38 of the preferred stake device 10 is shown near the first open end 30 of the frame 28 of the housing member 24, it is anticipated that the line receiving member 38 could be located at any point within the interior cavity 26 of the housing member 24. Additionally, while the preferred embodiment of the housing member 24 comprises a cylindrical frame 28, numerous other shapes are anticipated such as a three-sided housing member, a four-sided housing member, etc. Furthermore, while the housing member 24 of the preferred stake device 10 is shown with a first open end 30 and a second open end 32, it is contemplated that the second open end 32 could be closed about the stake member 14 without departing from the scope of the invention. In addition, the stake member 14 could be of a shape other than that shown and could be attached to the outside of the housing member 24 rather than being located in the interior cavity 26.

What is claimed is:

1. An improved stake device for prolonged or even permanent ground position and location in a manner which is completely submerged below ground level, said stake device allowing for engaging and holding a securement line, said stake device which remains in said ground position and location upon removal of said securement line from said stake device as well as during non-use, the improved stake device comprising:

(a) a longitudinal stake member, said stake member having a first end and a second end located distally and opposite to said first end;

(b) a housing member attached proximate to said first end of said stake member, said housing member having an interior cavity and an outer frame, said frame having a first open end and a second open end; and (c) a line receiving member extended laterally from said frame into said interior cavity of said housing member, said line receiving member for releasable fastening by corresponding connection means of said securement line for connection of said securement line to said line receiving member.

2. The invention, according to claim 1, in which said frame of said housing member is cylindrical in shape.

3. The invention, according to claim 1, in which said interior cavity of said housing member is circular in cross-section.

4. The invention, according to claim 1, in which said line receiving member is extended laterally from a side of said frame into said interior cavity to a point which is short of an opposing side of said frame.

5. The invention, according to claim 1, in which said line receiving member further comprises a down-turned hook-like member on an end of said line receiving member which is extended into said interior cavity of said housing member.

6. The invention, according to claim 1, in which said line receiving member is extended from a side of said frame into said interior cavity to an opposing side of said frame.

7. The invention, according to claim 1, in which said line receiving member comprises at least one rod-shaped leg.

8. The invention, according to claim 1, in which said line receiving member is located near said open end of said frame of said housing member.

9. The invention, according to claim 1, in which said first end of said stake member is attached to the frame of said housing member, said first end of said stake member being located within said interior cavity.

10. The invention, according to claim 1, in which said stake member comprises a channel having a V-shaped cross-section.

11. The invention, according to claim 1, in which said second end of said stake member is pointed.

12. The invention, according to claim 1, in which said line receiving member passes through said first end of said stake member in said interior cavity of said housing member.

13. The invention, according to claim 1, in which said stake member has a longitudinal axis, said stake member further comprising at least one barb which is extended from said stake member at an acute angle from a line which passes along the longitudinal axis of said stake member between said barb and said housing member to prevent upward movement of the stake member relative to the ground.

* * * * *